United States Patent [19]

Hollyday et al.

[11] 4,053,199

[45] Oct. 11, 1977

[54] CABLE CONNECTABLE BULKHEAD FILTER ARRAY

[75] Inventors: Robert David Hollyday; William Jeffrey Hudson, Jr., both of Hershey, Pa.

[73] Assignee: AMP Incorporated, Harrisburg, Pa.

[21] Appl. No.: 641,196

[22] Filed: Dec. 15, 1975

Related U.S. Application Data

[63] Continuation of Ser. No. 555,657, March 5, 1975, abandoned, which is a continuation-in-part of Ser. No. 423,944, Dec. 12, 1973, abandoned.

[51] Int. Cl.[2] ..... H01R 25/02

[52] U.S. Cl. ..... 339/147 R; 339/17 C; 339/91 R

[58] Field of Search ..... 339/17 C, 91 R, 94 R, 339/94 A, 94 M, 125 P, 147 R, 147 P

[56] References Cited

U.S. PATENT DOCUMENTS

| | | | |
|---|---|---|---|
| 1,621,000 | 3/1927 | Crowley | 339/94 M |
| 2,691,144 | 10/1954 | Parsons et al. | 339/147 P |
| 2,768,231 | 10/1956 | Schwennesen | 339/94 A UX |
| 2,946,927 | 7/1960 | Silver et al. | 339/17 C X |
| 3,388,368 | 6/1968 | Sauber | 339/94 A |
| 3,523,269 | 8/1970 | Witek et al. | 339/91 R |
| 3,651,446 | 3/1972 | Sadogierski et al. | 339/91 R |
| 3,696,323 | 10/1972 | Kinkaid et al. | 339/17 C X |
| 3,753,212 | 8/1973 | Yamada et al. | 339/91 R |
| 3,815,077 | 6/1974 | Anhalt et al. | 339/125 R X |

*Primary Examiner*—Roy Lake
*Assistant Examiner*—Howard N. Goldberg

[57] ABSTRACT

The disclosure relates to a connector portion for a filter array mounted in a panel or bulkhead. The filter and pin assemblies are soldered to the panel with their pins extending above the panel in a predetermined array for connection to an external connector. A connector housing is mounted on the panel and surrounds the filter pins, the external mating connector making a friction and/or lock securing connection to the connector housing and connection to the filter pins without application of stresses caused by an unsupported and/or unguided connection.

1 Claim, 4 Drawing Figures

CABLE CONNECTABLE BULKHEAD FILTER ARRAY

CROSS REFERENCE TO RELATED APPLICATION

This is a continuation of application Ser. No. 555,657, filed Mar. 5, 1975, now abandoned, which is a continuation-in-part of application Ser. No. 423,944, filed Dec. 12, 1973, and now abandoned.

This invention relates to a connector portion for a filter array and, more specifically, to a panel mounted connector housing for use with a panel mounted filter array to permit electrical connection to the filter array without application of stresses directly to the filter pins of the filter array during mating, unmating and operation of the connectors.

It is often necessary to provide plural external circuits, each having a filter therein, wherein each of the filters is directly connectable into and disconnectable from the circuits. This is accomplished by soldering plural ceramic type filters of well known type into a panel or bulkhead and then making electrical connection directly to the filter pins. While such connection is possible, it is well known that ceramic type filters are brittle and easily cracked or broken when stresses are applied thereto having a component normal to the axis of the filter sleeve. For this reason, since electrical connection directly to the filter pins would require a friction connection between pins and connector, there is always the possibility of application of such normal stresses during mating, unmating and operation of the connectors, since the connector is secured only to the pins. Therefore connection directly to the filter by a connector will inherently cause certain amount of filter breakage during mating, unmating and operation. It is apparent that since the filters are soldered into the panel prior to connection thereto, removal of broken and/or damaged filters already soldered into the panel is costly, both from the standpoint of filter breakage as well as removal and replacement thereof.

In accordance with the present invention, the above noted problems of the prior art are substantially overcome Briefly, in accordance with the present invention, the filters are soldered to the panel with their pins extending above the panel in a predetermined array for connection to an external connector. A connector housing is mounted on the panel and surrounds the filter pins, the external connector making a friction securing connection to the connector portion and connection to the filter pins without application of stresses caused by an unsupported and/or unguided connection.

It is therefore an object of this invention to provide a cable connectable filter array having an electrical connector housing mounted to a panel and surrounding the filter pins.

It is a further object of this invention to provide a panel mounted filter array having an auxiliary connector portion mounted on the panel for making friction connection to an external connector to the filter pins.

It is a yet further object of this invention to provide a connector portion for a panel mounted filter array for removing substantially all stresses from the filter array during mating, unmating and operation of the connectors.

The above objects and still further objects of the invention will immediately become apparent to those skilled in the art after consideration of the following preferred embodiment thereof, which is provided by way of example and not by way of limitation, wherein.

Figure 1:
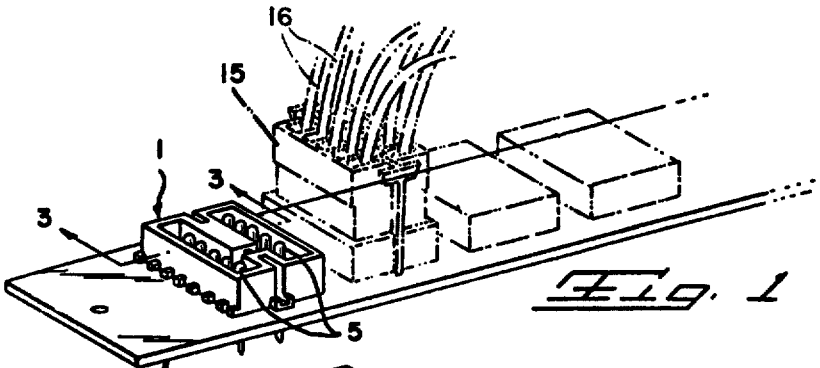
FIG. 1 is a view in elevation of a panel with plural filter arrays mounted therein with a connector housing in accordance with the present invention and mating connector portion.

Referring now to FIG. 1 there is shown an electrically conducting panel or bulkhead 3 having a plurality of filter assemblies 5 mounted therein, plural ones of the filter assemblies forming a filter array. An electrically insulating connector housing 1 is mounted to the panel 3 and surrounds the filter assemblies forming one filter array. A mating electrical connector portion 15 with an external cable is also shown. This external electrical connector portion mates with connector housing 1 and makes a friction fit therewith.

In usual practice the housing 15 includes a plurality of electrical receptacles secured to individual wires 16, which wires comprise the external cable for the connector portion 15.

Figure 2:
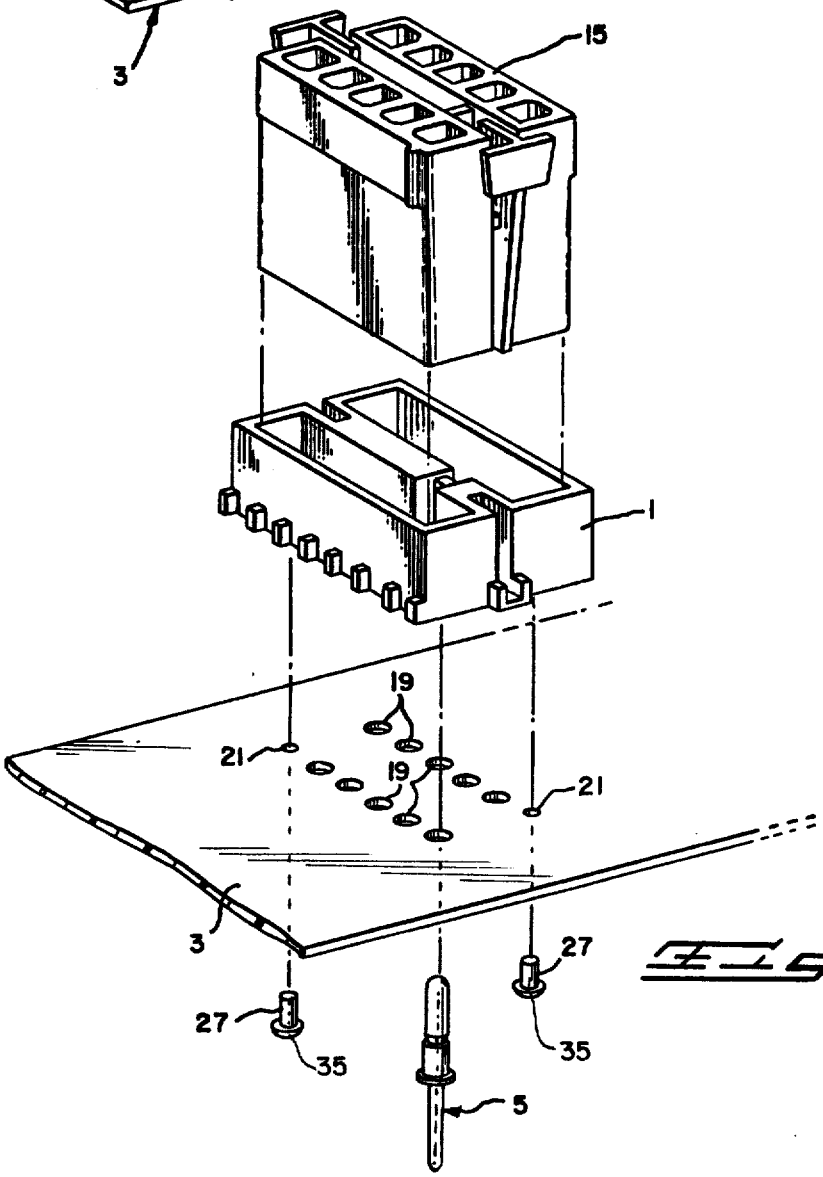
FIG. 2 is an exploded view of one of the filter arrays of FIG. 1.

Referring now to FIG. 2, there is shown an exploded view of one of the filter arrays of FIG. 1. The panel 3 includes a plurality of apertures 19 into which the filter assemblies 5 will be soldered as will be explained in more detail hereinbelow. The connector housing 1 sits on the panel 3 and surrounds the filter assemblies 5 of the array, the housing being secured to the panel by means of rivets 27 passing through apertures 21 in the panel and locking in the housing. The mating connector 15 mates with connector housing 1 and makes contact with the pin 9 (FIG. 4) of each of the filter assemblies.

Figure 3:
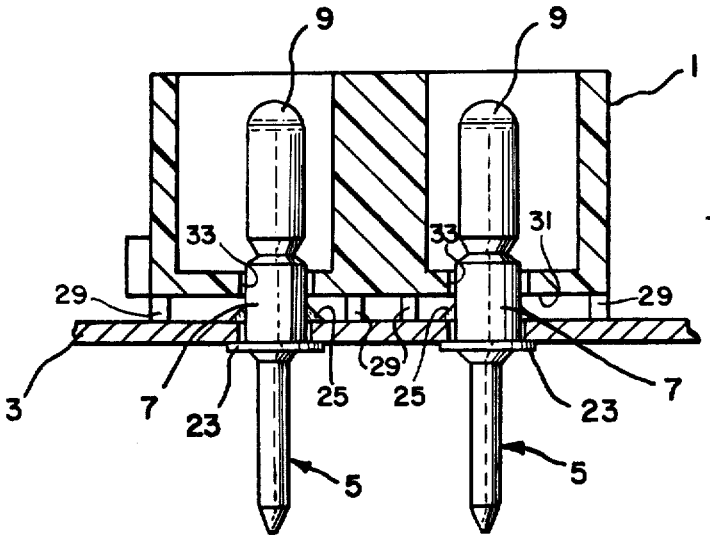
FIG. 3 is a view taken along the line 3—3 of FIG. 1.
Figure 4:
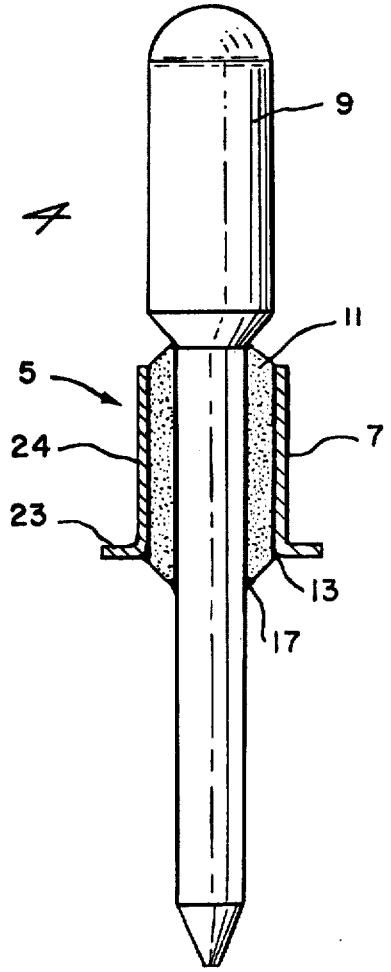
FIG. 4 is a cross-section view of one of the filter assemblies.

Referring now to FIGS. 3 and 4 the assembled device can be better understood. The filter assembly 5 includes a pin 9 of electrically conductive material to which a ceramic filter sleeve 11 of well known type is joined with an electrically conductive material 17. An electrically conductive eyelet 7 is joined to the exterior portion of filter sleeve 11 with an electrically conductive material 13, the eyelet having a flange 23 and body 24 for joining the filter assembly to the panel. It can be seen in FIG. 3 that the filter assemblies 5 have been joined to the panel 3 at the flange 23 and body 24, each of the filter pins 9 being surrounded by the connector housing 1. The mating connector portion 15 makes a supported fit with the housing 1 and cannot be moved laterally of the filter axes, thereby preventing application to the filter assemblies of stresses normal to the filter sleeve.

The filter assemblies 5 are attached by solder 25 within the apertures 19 of the panel 3. As shown the solder forms frusto-conical fillets encircling and adhering to corresponding eyelets 7. Also as shown in FIG. 3 the housing is provided with projecting feet 29 which space the bottom wall 31 of the housing from the panel 3. The bottom wall has apertures 33 therethrough freely receiving the eyelets 7. The bottom wall is accordingly spaced from the filter assemblies such that if twisting or bending force occur during coupling or uncoupling of the housing 15 to the housing 1, the housing 1 will absorb the resultant stresses and will not transmit the stresses to the filter assemblies. Thus when connecting the electrical receptacles of the housing 15 to the corresponding filter assemblies, the filter assemblies are isoated from the stresses acting normal to their longitudinal axes and breakage thereof is prevented. The rivets 27 can be inserted through selected apertures 33 of the bottom wall 31 which are shown in FIG. 3. The rivets are formed with enlarged tabs 35 in the well known manner to retain the housing 1 on the panel 3.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

What is claimed is:

1. A filter array comprising a printed circuit board, a pin, a filter sleeve joined electrically over said pin, said pin and said filter being retained in said printed circuit board, said pin having a portion projecting outwardly of said printed circuit board, a first housing mounted on said printed circuit board and encircling said filter and said pin, a second housing coupling with said first housing and capable of being uncoupled therefrom, an electrical receptacle contained in said second housing and removably coupled to the projecting portion of said pin, a bottom wall of said first housing in spaced relationship from said printed circuit board, and an aperture in said bottom wall encircling said filter and said pin, said aperture being larger than said filter and said pin, said bottom wall thereby being spaced from said filter and said pin to prevent transmission of stresses to said filter and said pin upon coupling or uncoupling said first and second housings.

* * * * *